US010350642B2

(12) United States Patent
Schillo-Armstrong et al.

(10) Patent No.: US 10,350,642 B2
(45) Date of Patent: Jul. 16, 2019

(54) METHOD OF SHAPE SORTING CRUSHED ABRASIVE PARTICLES

(71) Applicant: 3M INNOVATIVE PROPERTIES COMPANY, St. Paul, MN (US)

(72) Inventors: Melissa C. Schillo-Armstrong, Stillwater, MN (US); Brian D. Goers, Minneapolis, MN (US); Joseph B. Eckel, Vadnais Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/775,554

(22) PCT Filed: Nov. 8, 2016

(86) PCT No.: PCT/US2016/060898

§ 371 (c)(1),
(2) Date: May 11, 2018

(87) PCT Pub. No.: WO2017/083249

PCT Pub. Date: May 18, 2017

(65) Prior Publication Data

US 2018/0318880 A1 Nov. 8, 2018

Related U.S. Application Data

(60) Provisional application No. 62/254,864, filed on Nov. 13, 2015.

(51) Int. Cl.
*B07B 13/02* (2006.01)
*B07B 13/00* (2006.01)
(Continued)

(52) U.S. Cl.
CPC ..... *B07B 13/02* (2013.01); *B07B 13/003* (2013.01); *B07B 13/05* (2013.01); *B24D 18/0072* (2013.01)

(58) Field of Classification Search
CPC ..... B07B 15/04; B07B 15/05; B07B 15/00; B07B 13/04; B07B 13/05; B07B 13/02;
(Continued)

(56) References Cited

U.S. PATENT DOCUMENTS 208,257 A * 9/1878 Morgan ..... B07B 13/02 209/684
691,876 A * 1/1902 Scott ..... B07B 13/04 209/680
(Continued)

FOREIGN PATENT DOCUMENTS

JP 06-190725 7/1994
WO WO 2012-112305 8/2012
(Continued)

OTHER PUBLICATIONS

International Search Report for PCT International Application No. PCT/US2016/060898, dated Mar. 6, 2017, 3 pages.

*Primary Examiner* — Joseph C Rodriguez
(74) *Attorney, Agent, or Firm* — Bradford B. Wright

(57) ABSTRACT

A method of shape sorting abrasive particles involves disposing initial crushed abrasive particles with agitation against the surface of a tool, the surface defining a plurality of shaped cavities having an average aspect ratio of at least 1.2, thereby causing a first portion of the initial crushed abrasive particles to become retained within at least some of the shaped cavities, and causing a second portion of the initial crushed abrasive particles to remain as loose particles on the surface. Substantially all of the shaped cavities contain at most one abrasive particle. The second portion of the initial crushed abrasive particles is separated from the tool. The first portion of the initial crushed abrasive particles is then separated from the tool and isolated as loose sorted crushed abrasive particles. The average aspect ratio of the
(Continued)

loose sorted crushed abrasive particles is greater than that of the initial crushed abrasive particles.

12 Claims, 4 Drawing Sheets

(51) Int. Cl.
*B07B 13/05* (2006.01)
*B24D 18/00* (2006.01)

(58) Field of Classification Search
CPC ..... B07B 13/003; C09K 3/14; C09K 3/1409; B24B 1/00; B24D 11/00; B24D 11/01
USPC ..... 209/684–687
See application file for complete search history.

(56) References Cited

U.S. PATENT DOCUMENTS 1,676,519 A * 7/1928 Carter ..... B07B 13/02 209/684
1,910,444 A 5/1933 Nicholson
3,041,156 A 6/1962 Rowse
3,672,500 A * 6/1972 Hayes ..... B07B 13/11 209/695
4,261,706 A * 4/1981 Blanding ..... B01J 2/22 264/122
4,314,827 A 2/1982 Leitheiser
4,623,364 A 11/1986 Cottringer
4,652,275 A 3/1987 Bloecher
4,734,104 A 3/1988 Broberg
4,737,163 A 4/1988 Larkey
4,744,802 A 5/1988 Schwabel
4,770,671 A 9/1988 Monroe
4,799,939 A 1/1989 Bloecher
4,800,685 A 1/1989 Haynes, Jr.
4,880,530 A * 11/1989 Frey ..... B01D 46/0068 209/380
4,881,951 A 11/1989 Wood
4,898,597 A 2/1990 Hay
4,933,373 A 6/1990 Moren
4,978,443 A * 12/1990 Cashman ..... B07B 13/02 209/684
4,997,461 A 3/1991 Markhoff-Matheny
5,009,675 A 4/1991 Kunz
5,011,508 A 4/1991 Wald
5,042,991 A 8/1991 Kunz
5,085,671 A 2/1992 Martin
5,152,917 A 10/1992 Pieper
5,201,916 A 4/1993 Berg
5,203,884 A 4/1993 Buchanan
5,213,591 A 5/1993 Celikkaya
5,255,793 A * 10/1993 DenBesten ..... B03B 5/28 209/17
5,282,875 A 2/1994 Wood
5,352,254 A 10/1994 Celikkaya
5,366,523 A 11/1994 Rowenhorst
5,372,620 A 12/1994 Rowse
5,378,251 A 1/1995 Culler
5,435,816 A 7/1995 Spurgeon
5,436,063 A 7/1995 Follett
5,496,386 A 3/1996 Broberg
5,520,711 A 5/1996 Helmin
5,609,706 A 3/1997 Benedict
5,630,554 A * 5/1997 Izumikawa ..... B03B 9/061 241/24.13
RE35,570 E 7/1997 Rowenhorst
5,672,097 A 9/1997 Hoopman
5,802,965 A * 9/1998 Lin ..... B07B 1/28 209/629
5,946,991 A 9/1999 Hoopman
5,961,674 A 10/1999 Gagliardi
5,975,987 A 11/1999 Hoopman
5,975,988 A 11/1999 Christianson
5,984,988 A 11/1999 Berg
6,129,540 A 10/2000 Hoopman
6,398,036 B1 * 6/2002 Griebat ..... B07B 13/02 209/467
6,635,840 B1 * 10/2003 Mailloux ..... B07B 9/00 209/586
6,669,745 B2 12/2003 Prichard
7,246,707 B2 * 7/2007 Black ..... B07B 1/10 209/684
7,556,558 B2 * 7/2009 Palmgren ..... B24D 18/00 451/540
8,034,137 B2 10/2011 Erickson
8,142,531 B2 3/2012 Adefris
8,142,532 B2 3/2012 Erickson
8,142,891 B2 3/2012 Culler
8,628,597 B2 1/2014 Palmgren
8,840,696 B2 * 9/2014 Kavanaugh ..... C09K 3/1409 51/307
9,938,440 B2 * 4/2018 Bujnowski ..... C09K 3/1409
9,982,176 B2 * 5/2018 Dumm ..... C01B 25/165
2005/0081455 A1 4/2005 Welygan
2006/0243832 A1 * 11/2006 McMinn ..... B07B 9/00 241/24.1
2007/0138066 A1 6/2007 Malmberg
2009/0017727 A1 1/2009 Pribyl
2009/0165394 A1 7/2009 Culler
2009/0169816 A1 7/2009 Erickson
2011/0031167 A1 2/2011 Augst
2011/0031169 A1 2/2011 Folgner
2011/0296767 A1 12/2011 Lee
2012/0227333 A1 9/2012 Adefris
2013/0040537 A1 2/2013 Schwabel
2013/0125477 A1 5/2013 Adefris
2013/0203328 A1 8/2013 Givot
2013/0344786 A1 12/2013 Keipert
2014/0287654 A1 9/2014 Schwabel
2015/0052825 A1 2/2015 Adefris
2017/0225298 A1 * 8/2017 Goers ..... B24D 7/02

FOREIGN PATENT DOCUMENTS

WO WO 2014-161001 10/2014
WO WO 2015-100018 7/2015
WO WO 2015-100020 7/2015
WO WO 2015-100220 7/2015
WO WO 2016/044158 3/2016
WO WO 2016/064726 4/2016
WO WO 2017-083255 5/2017

* cited by examiner

METHOD OF SHAPE SORTING CRUSHED ABRASIVE PARTICLES

TECHNICAL FIELD

The present disclosure broadly relates to methods of shape sorting abrasive particles.

BACKGROUND

Crushed abrasive particles are formed by mechanically crushing abrasive mineral. Due to the random nature of the crushing operation, the resultant particles are typically randomly shaped and sized. Ordinary, initially produced crushed abrasive particles are sorted by size for use later use in various abrasive products and applications.

Within a given distribution of crushed abrasive particles there will be a variety of sizes and shapes. Size sorting is typically carried out by sieving (i.e., using standard mesh sizes) and/or air classification methods, for example.

Shape sorting, typically to isolate large aspect ratio abrasive particles is more complicated and known methods such shape sorting tables and tweezers are impractical for large volumes and have been used generally only for expensive abrasive particles such as, for example, diamond (which are not crushed abrasive particles). In general, high aspect ratio particles, especially if oriented, exhibit superior abrading performance as compared to blockier shapes.

It would be desirable to have a method of shape sorting abrasive particles to improve their average aspect ratio that could be inexpensively carried out for large volumes of abrasive particles, preferably in a continuous manner.

SUMMARY

The present disclosure overcomes this unmet need in the abrasives art by providing a simple method suitable for high volume continuous processing.

Accordingly, in one aspect the present disclosure provides a method of shape sorting abrasive particles, the method comprising:

providing a tool having a surface (preferably a major surface) defining a plurality of shaped cavities having an average aspect ratio of at least 1.2;

providing initial crushed abrasive particles having a first average aspect ratio;

urging the initial crushed abrasive particles with agitation against the surface of the tool, thereby causing a first portion of the initial crushed abrasive particles to become retained within at least some of the shaped cavities and causing a second portion of the initial crushed abrasive particles to remain as loose particles on the surface of the tool, wherein substantially all of the shaped cavities contain at most one crushed abrasive particle;

separating the second portion of the initial crushed abrasive particles from the tool; and separating substantially all of the first portion of the initial crushed abrasive particles from the tool and isolating them as loose sorted crushed abrasive particles having a second average aspect ratio that is greater than the first average aspect ratio.

As used herein, the term "identically-shaped cavities" refers to cavities having the same, within typical manufacturing tolerances, dimensions and orientation with respect to a single major surface of a tool (e.g., an endless belt or a sheet).

As used herein, the term "precisely-shaped" in reference to cavities in a tool refers to cavities having three-dimensional shapes that are defined by relatively smooth-surfaced sides that are bounded and joined by well-defined sharp edges having distinct edge lengths with distinct endpoints defined by the intersections of the various sides.

Features and advantages of the present disclosure will be further understood upon consideration of the detailed description as well as the appended claims.

It should be understood that numerous other modifications and embodiments can be devised by those skilled in the art, which fall within the scope and spirit of the principles of the disclosure. The figures may not be drawn to scale.

DETAILED DESCRIPTION

Figure 1:
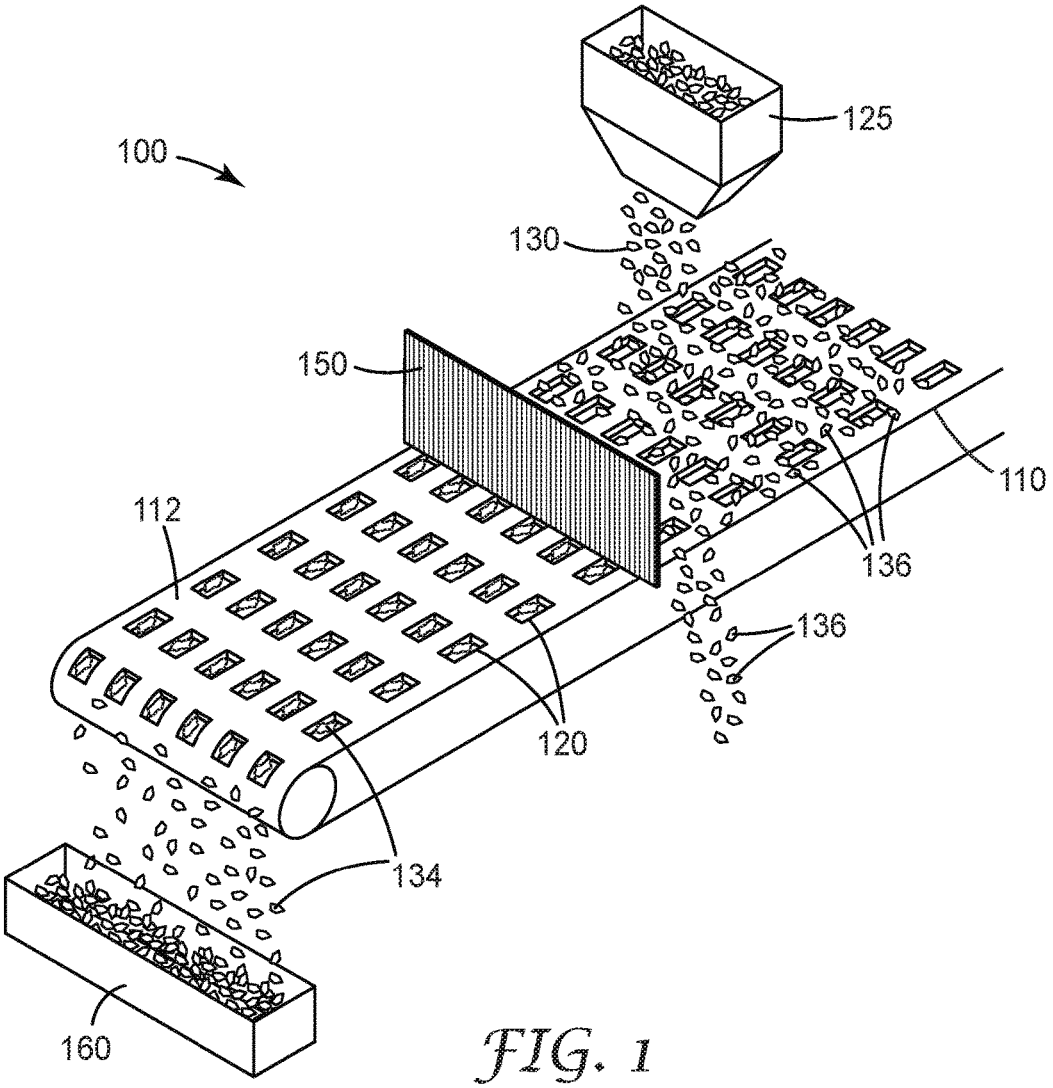
FIG. 1 is a schematic perspective view showing an exemplary method 100 of practicing the present disclosure.

An exemplary method 100 for shape-sorting crushed abrasive particles in shown in FIG. 1. Referring now to FIG. 1, tool 110 (shown as an endless belt) has a plurality of shaped cavities 120 disposed on surface 112. Initial crushed abrasive particles 130 have a first average aspect ratio. Crushed abrasive particles 130 are dispensed (i.e., urged by gravity) from dispenser 125 onto surface 112 of tool 110, which is mechanically vibrated with sufficient energy that the crushed abrasive particles 130 settle into cavities 120 in a preferential manner that favors higher aspect ratio crushed abrasive particles 134 being retained in the cavities. Conversely, lower aspect ratio (e.g., blocky) crushed abrasive particles 136 are not as highly retained in the cavities and are swept away by brush 150. Lastly, higher aspect ratio abrasive particles 134 are removed from cavities 120 and collected in bin 160 as loose sorted crushed abrasive particles.

While this method illustrated in FIG. 1 is continuous, it will be recognized that the method may also be carried out as a batch process.

Advantageously, this process can be readily implemented with relatively large grades of crushed abrasive particles. For example, the crushed abrasive particles may have an average particle diameter $D_{50}$ of at least 0.05, 0.06, 0.07, 0.08, 0.09, 0.1, 0.2, 0.3, 0.4, 0.5, 0.6, 0.7, 0.8, or 0.9 millimeters, or more. However, smaller abrasive particles can be used if desired.

The tool may have any suitable form. Examples include drums, endless belts, discs, and sheets. The tool may be rigid or flexible, but preferably is sufficiently flexible to permit use of normal web handling devices such as rollers. Suitable materials for fabricating the tool include, for example, thermoplastics (e.g., polyethylene, polypropylene, polycarbonate, polyimide, polyester, polyamides, acrylonitrile-butadiene-styrene plastic (ABS), polyethylene terephthalate (PET), polybutylene terephthalate (PET), polyimides, polyetheretherketone (PEEK), polyetherketone (PEK), and polyoxymethylene plastic (POM, acetal), poly(ether sulfone), poly(methyl methacrylate), polyurethanes, polyvinyl chloride, and combinations thereof), metal, and natural, EPDM and/or silicone rubber. Commercially available suitable materials include those suitable for use with 3D printers such as, for example, those marketed by 3D Systems, Rock Hill, S.C., under the trade designations "VISIJET SL", and "ACCURA" (e.g., Accura 60 plastic).

Referring now to FIG. 2A, exemplary tool 210 has major surface 212 that defines a plurality of identical precisely-shaped cavities 220 disposed on surface 212. While FIG. 2A shows the openings of the cavities are rectangular, this is not a requirement, and they may have any shape. The length, width, and depth of the cavities in the carrier member will generally be determined at least in part by the shape and size of the crushed abrasive particles with which they are to be used.

Figure 2:
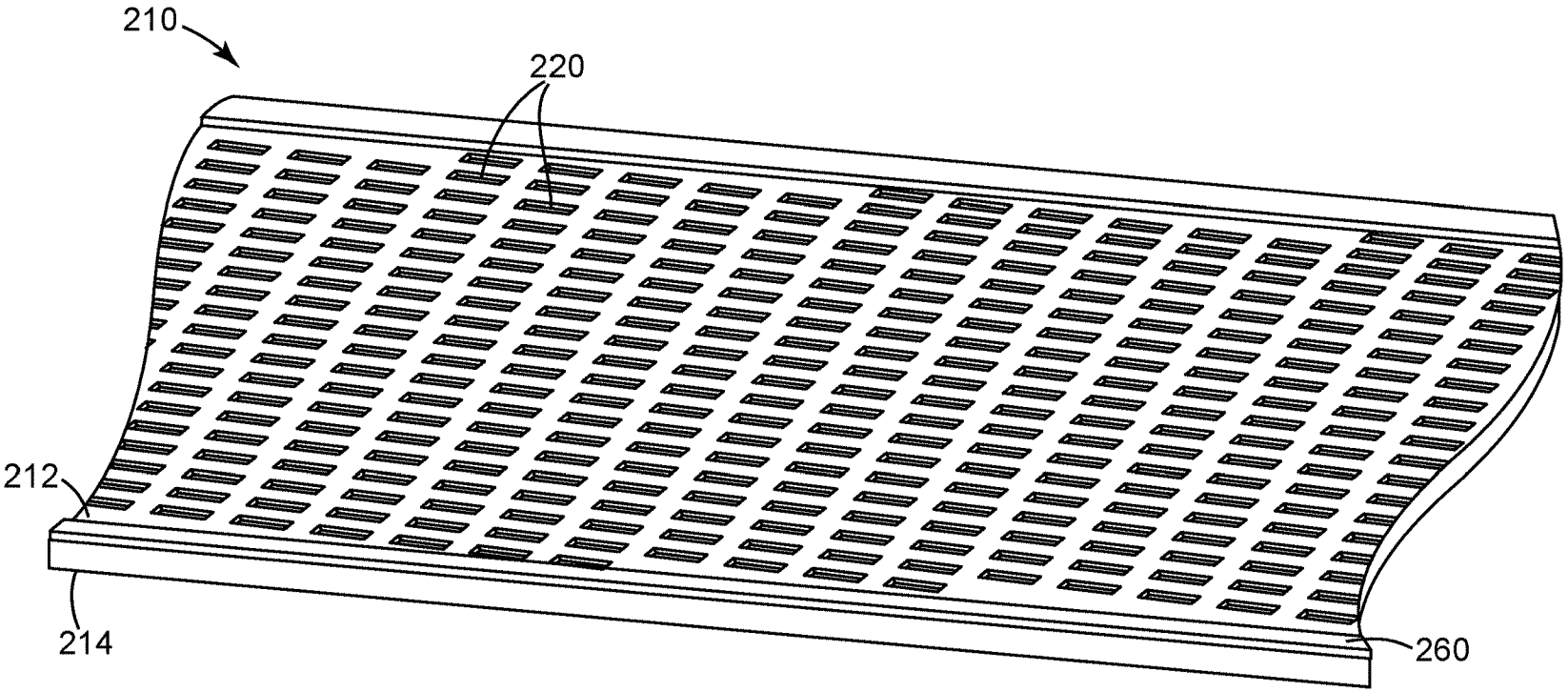
FIG. 2 is a schematic perspective view of an exemplary tool 210 suitable for practicing the present disclosure.

For example, for vertically oriented (i.e., perpendicular to the surface of the tool) cavities as shown in FIG. 2, with depths sufficient to accommodate a crushed abrasive particle, the length and width of the cavity openings should be sufficiently sized large that it can accommodate a single crush abrasive particle, and are preferably less (e.g., at least 10, 20, 30, 40, or even 50 percent less) than or equal to the average particle diameter of the crushed abrasive particles.

Figure 3A:
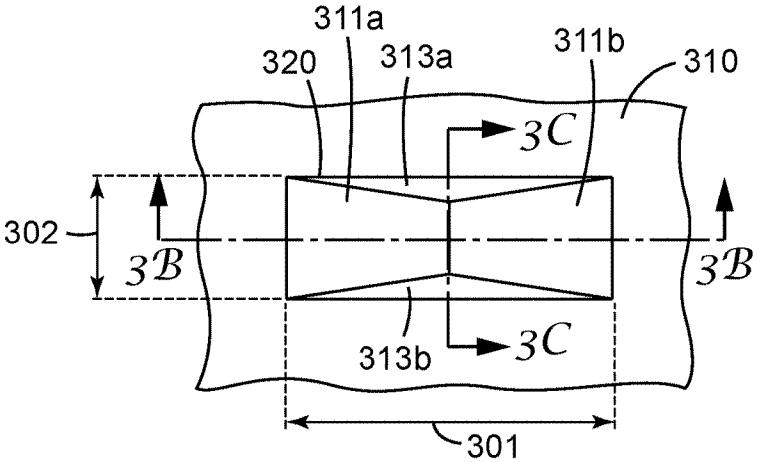
FIG. 3A is an enlarged schematic top view of cavity 220 shown in FIG. 2.
Figure 3C:
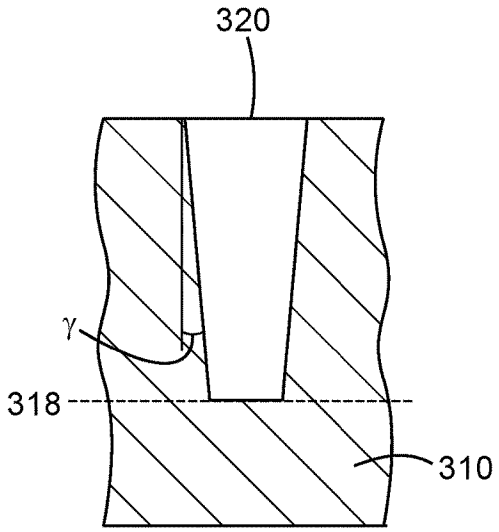
FIG. 3C is a cross-sectional view of FIG. 3A taken along plane 3C-3C.
Figure 3B:
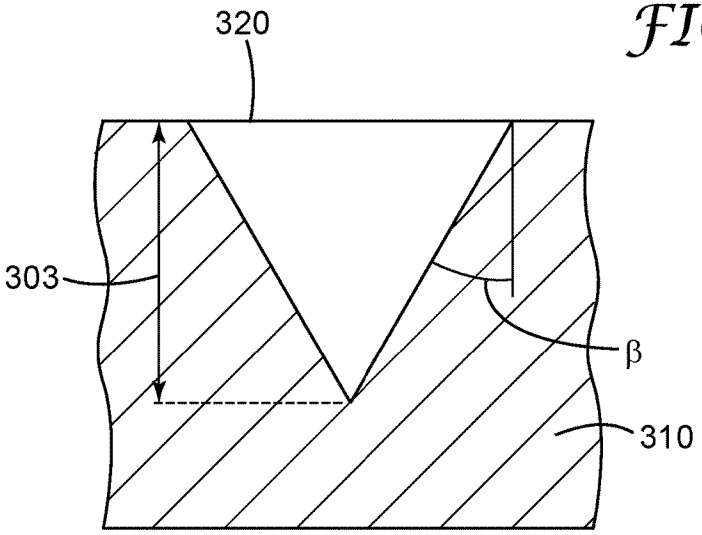
FIG. 3B is cross-sectional view of FIG. 3A taken along plane 3B-3B.

Referring now to FIGS. 3A-3C, cavities 320 are shaped as a triangular cavity that tapers inward on each side to meet at a line and the bottom of the cavity (e.g., as shown in WO 2015/100220 A1 (Culler et al.).

On the other hand, if the cavities are relatively shallow and horizontally oriented (i.e., parallel to the surface of the tool), then the length of the cavity opening should be larger (e.g., at least 10, 20, 30, 40, or even 50 percent larger) than the average particle diameter of the crushed abrasive particles, while the depths and widths of the cavities are preferably less than the average particle diameter of the crushed abrasive particles.

Figure 4A:
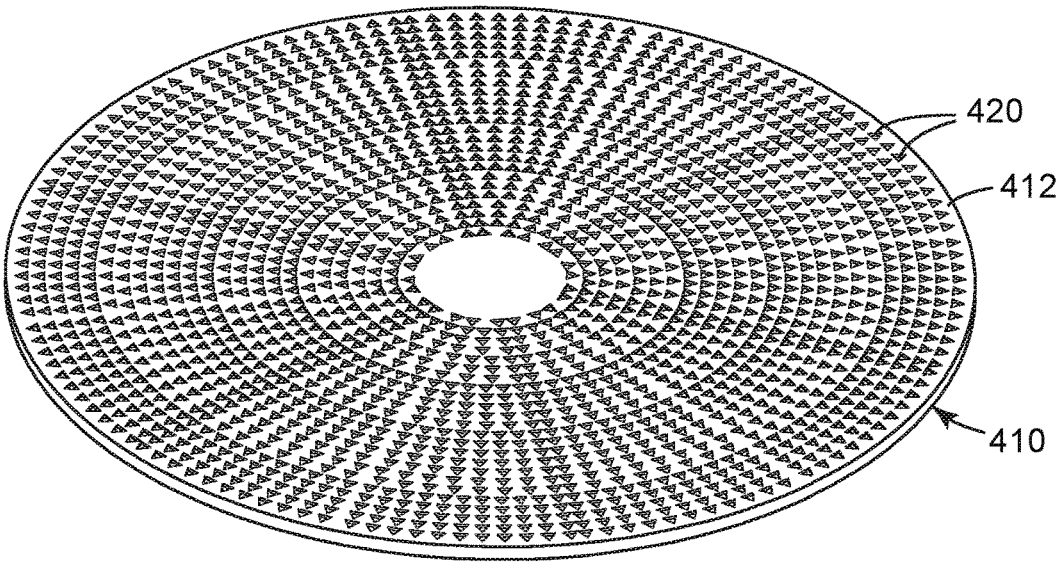
FIG. 4A is a schematic perspective view of an exemplary tool 410 suitable for practicing the present disclosure.
Figure 4B:
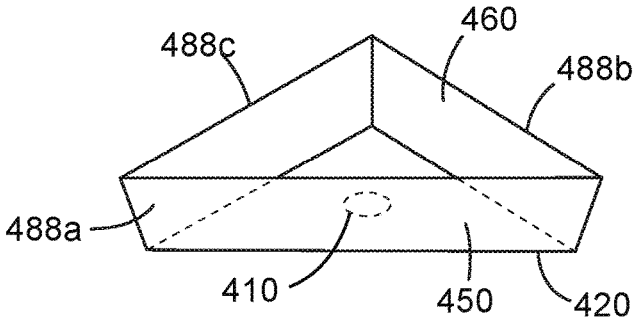
FIG. 4B is an enlarged perspective view of a cavity 420 shown in FIG. 4A.

Such a tool is shown in FIGS. 4A and 4B. Referring now to FIG. 4A, exemplary tool 410 has major surface 412 that defines a plurality of identical precisely-shaped cavities 420 disposed on surface 412. As shown in FIG. 4B, cavities 420 are shaped as truncated equilateral triangular pyramids having sidewalls 488*a*, 488*b*, 488*c* that taper inwardly from a planar top 460 to a planar bottom 450. The above configurations will tend to cause the crushed abrasive particles with larger aspect ratios to be preferentially retained in the cavities.

The tool can be in the form of, for example, an endless belt, a sheet, a continuous sheet or web, a coating roll, a sleeve mounted on a coating roll, or die. If the tool is in the form of a belt, sheet, web, or sleeve, it will have a contacting surface and a non-contacting surface. The pattern of the contacting surface of the production tool will generally be characterized by a plurality of cavities or recesses. The opening of these cavities can have any shape, regular or irregular, such as, for example, a rectangle, semi-circle, circle, triangle, square, hexagon, or octagon. The walls of the cavities can be vertical or tapered. The pattern formed by the cavities can be arranged according to a specified plan or can be random. While the cavities may be arranged in a regular array, to maximize surface are coverage, they may also be randomly oriented, as once the crushed abrasive particles are removed from the cavities they lose all spatial orientation relation to each other crushed abrasive particles.

Useful tools may have any shapes and/or sizes of cavities. Examples of suitable cavity shapes include: oblong cavities such as rectangular prisms and pyramids, triangular prisms and pyramids (e.g., with isosceles and obtuse triangle bases); and equilateral triangular and tetragonal prisms and pyramids; conical cavities, prolate cavities; and ovoid cavities. The above pyramidal and conical shapes may also be truncated. The cavities may be oriented, for example, parallel or perpendicular to the surface of the tool.

Further details concerning methods for making tools useful for practicing practice the present disclosure are described in PCT Intl. Publ. No. WO 2012/100018 A1 (Culler et al.) and U.S. Pat. Appln. Publ. 2013/0344786 A1 (Keipert).

Referring now to FIGS. 3A-3C, cavity 320 has length 301 and width 302 (see FIG. 3A), and depth 303 (see FIG. 3B). Cavity 320 comprises four sidewalls 311*a*, 311*b*, 313*a*, 313*b*. Sidewalls 311*a*, 311*b* taper inward at a taper angle β with increasing depth until they meet at line 318 (see FIG. 3C). Likewise, sidewalls 313*a*, 313*b* taper inwardly at a taper angle γ with increasing depth until they contact line 318 (see FIGS. 3A, 3B, and 3C).

Taper angles β and γ will typically depend on the specific abrasive particles selected for use with the production tool, preferably corresponding to the shape of the abrasive particles. In this embodiment, taper angle β may have any angle greater than 0 and less than 90 degrees. In some embodiments, taper angle β has a value in the range of 40 to 80 degrees, preferably 50 to 70 degrees, and more preferably 55 to 65 degrees. Taper angle γ will likewise typically depend on the specific abrasive particles to be selected. In this embodiment, taper angle γ may have any angle in the range of from 0 and to 30 degrees. In some embodiments, taper angle γ has a value in the range of 5 to 20 degrees, preferably 5 to 15 degrees, and more preferably 8 to 12 degrees.

The cavities may have a second opening at the bottom of each cavity extending to a second surface opposite the surface defining the cavities, which may be in fluid communication with a reduced pressure source such as, for example, a vacuum pump. In such cases, the second opening is preferably smaller than the first opening such that the abrasive particles do not pass completely through both openings (i.e., the second opening is small enough to prevent passage of the abrasive particles through the carrier member). In preferred embodiments, each cavity has a single opening.

Instead of vertically oriented cavities, the tool may have horizontally oriented cavities. For example, in some embodiments, exemplified in FIG. 4A, tool 410 has cavities 420 defined by surface 412. Major surface 412 has a plurality of identical precisely-shaped (as truncated triangular pyramids) cavities 420 formed therein. Cavities 420 are relatively shallow (they have a depth less than both of the length and width) and are arranged parallel to surface 412. Each cavity 420 has an optional hole 440 at its bottom face 450 through which vacuum can be applied (see FIG. 4B).

The cavity sidewalls are preferably smooth, although this is not a requirement. The sidewalls may be planar, curviplanar (e.g., concave or convex), conical, or frustoconical, for example. The cavities may have a discrete bottom surface (e.g., a planar bottom parallel to the tool surface) or the sidewalls may meet at a point or a line, for example. Side walls of the cavities may be vertical (i.e., perpendicular to the surface of the tool) or tapered inward, for example.

In some embodiments, at least some of the cavities comprise first, second, third, and fourth sidewalls. In such embodiments, the first, second, third, and fourth side walls may be consecutive and contiguous.

The average aspect ratio of the longitudinal axes of the cavities (i.e., the ratio of length:width) is at least 1.2. Preferably, the average aspect ratio is at least 1.2, at least 1.25, at least 1.3, at least 1.35, or at least 1.4, or more.

Examples of suitable cavity shapes include: oblong cavities such as rectangular prisms and pyramids, triangular prisms and pyramids (e.g., with isosceles and obtuse triangle bases); and equilateral triangular and tetragonal prisms and pyramids; conical cavities, prolate cavities; and ovoid cavities. The above pyramidal and conical shapes may also be truncated.

The crushed abrasive particles are typically randomly shaped due to the nature of mechanical crushing. The abrasive particles generally are formed of mineral have a Mohs hardness of at least 4, 5, 6, 7 or even at least 8. Examples of suitable minerals include fused aluminum oxide (which includes brown aluminum oxide, heat treated aluminum oxide, and white aluminum oxide), co-fused alumina-zirconia, ceramic aluminum oxide, green silicon carbide, black silicon carbide, chromia, zirconia, flint, cubic boron nitride, boron carbide, garnet, sintered alpha-alumina-based ceramic, and combinations thereof. Sintered alpha-alumina-based ceramic abrasive granules are described, for example, by U.S. Pat. No. 4,314,827 (Leitheiser et al.) and in U.S. Pat. Nos. 4,770,671 and 4,881,951 (both to Monroe et al.). The alpha-alumina-based ceramic abrasive may also be seeded (with or without modifiers) with a nucleating material such as iron oxide or alpha-alumina particles as disclosed by Schwabel, U.S. Pat. No. 4,744,802 (Schwabel). The term "alpha-alumina-based ceramic abrasive granules" as herein used is intended to include unmodified, modified, seeded and unmodified, and seeded and modified ceramic granules.

Crushed abrasive particles are generally graded to a given particle size distribution before use. Such distributions typically have a range of particle sizes, from coarse particles to fine particles. In the abrasive art this range is sometimes referred to as a "coarse", "control", and "fine" fractions. Abrasive particles graded according to abrasive industry accepted grading standards specify the particle size distribution for each nominal grade within numerical limits. Such industry accepted grading standards (i.e., abrasives industry specified nominal grade) include those known as the American National Standards Institute, Inc. (ANSI) standards, Federation of European Producers of Abrasive Products (FEPA) standards, and Japanese Industrial Standard (JIS) standards.

ANSI grade designations (i.e., specified nominal grades) include: ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600. FEPA grade designations include P8, P12, P16, P24, P36, P40, P50, P60, P80, P100, P120, P150, P180, P220, P320, P400, P500, P600, P800, P1000, and P1200. JIS grade designations include JIS8, JIS12, JIS16, JIS24, JIS36, JIS 46, JIS 54, JIS 60, JIS 80, JIS 100, JIS 150, JIS 180, JIS 220, JIS 240, JIS 280, JIS 320, JIS 360, JIS 400, JIS 600, JIS 800, JIS 1000, JIS 1500, JIS 2500, JIS 4000, JIS 6000, JIS8000, and JIS 10000.

Alternatively, crushed abrasive particles can be graded to a nominal screened grade using U.S.A. Standard Test Sieves conforming to ASTM E-11 "Standard Specification for Wire Cloth and Sieves for Testing Purposes". ASTM E-11 proscribes the requirements for the design and construction of testing sieves using a medium of woven wire cloth mounted in a frame for the classification of materials according to a designated particle size. A typical designation may be represented as −18+20 meaning that the abrasive particles through a test sieve meeting ASTM E-11 specifications for the number 18 sieve and are retained on a test sieve meeting ASTM E-11 specifications for the number 20 sieve. In one embodiment, the crushed abrasive particles have a particle size such that most of the particles pass through an 18 mesh test sieve and can be retained on a 20, 25, 30, 35, 40, 45, or 50 mesh test sieve. In various embodiments of the disclosure, the crushed abrasive particles can have a nominal screened grade comprising: −18+20, −20+25, −25+30, −30+35, −35+40, −40+45, −45+50, −50+60, −60+70, −70+80, −80+100, −100+120, −120+140, −140+170, −170+200, −200+230, −230+270, −270+325, −325+400, −400+450, −450+500, or −500+635.

Methods according to the present disclosure provide practical means to shape sort large volumes of abrasive particle (especially in larger grades) in a timely manner, resulting in abrasive particles with a higher average aspect ratio (length to width) than was present in the crushed abrasive particles prior to shape sorting. The degree of enhancement may vary depending, for example, on the shape of the cavities in the tool, and their relation to the size and shape of the crushed abrasive particles. For example, cavities that are too small in one or more dimensions will not be able to retain an abrasive particle, especially with agitation, within a cavity. Likewise, cavities that are overly large relative to the abrasive particles being sorted may result in reduced effectiveness with respect to shape sorting. The degree of agitation needed to properly sort the particles into the cavities may also vary depending on the size and/or shape of the cavities and the abrasive particles. Accordingly, these parameters will typically vary with the crushed abrasive particles and tool that are selected. Selection of both such parameters are within the capability of those skilled in the art.

Average aspect ratios of the abrasive particles can be determined by well-known methods. For example, they can be determined in accordance with ISO 9276-6. Commercially available dynamic image analyzers are capable of readily performing such measurements. One such dynamic image analyzer is a CAMSIZER XT particle shape analyzer from Retsch Technology, Haan, Germany. Another suitable dynamic image analyzer is a CLEMEX PSA particle shape analyzer from Clemex Technologies, Longueuil, Quebec.

Once the crushed abrasive particles are disposed onto the surface of the tool, they are agitated and gradually some of the particles settle into the cavities on the surface of the tool, while others remain loose on its surface. It will be recognized that a particle may alternately reside in and out of a cavity due to agitation, but that on average the crushed abrasive particles will tend toward an equilibrium state in which crushed abrasive particles with complementary sizes and shapes to the cavities will be preferentially retained in them.

Agitation of the crushed abrasive particles while in contact with the tool may be accomplished by any suitable means. Examples include mechanical agitation of the tool (e.g., using vibrating motors) and/or blowing air.

Once the crushed abrasive particles have at least partially (preferably completely) reached equilibrium in settling into the cavities on the surface of the tool, the excess loose crushed abrasive particles that remain on the surface of the tool are separated from the tool (and therefore also the abrasive particles residing in its cavities). This may be accomplished by any suitable means. Examples include inclining the surface of the tool such that gravity urges the loose particles away from the tool, wiping with a brush, and blowing air.

After excess loose crushed abrasive particles on the tool have been removed, the abrasive particles are separated from the tool by inverting the cavities so that gravity causes them to fall out. In cases where a vacuum assist is used to help retain the abrasive particles in the cavities, it is preferably discontinued to aid the separation of the particles from the tool.

The resultant loose sorted crushed abrasive particles are isolated as loose particles. Advantageously, by following the method of the disclosure herein, the average aspect ratio of the loose sorted crushed abrasive particles (i.e., second average aspect ratio) is enhanced relative to the initial crushed abrasive particles (i.e., first average aspect ratio). For example, the second average aspect ratio may be at least 5 percent, at least 10 percent, at least 20 percent, at least 30 percent, at least 40 percent, at least 50 percent, at least 60 percent, at least 70 percent, at least 80 percent, or at least 90 percent larger than the first average aspect ratio, or even larger.

SELECT EMBODIMENTS OF THE PRESENT DISCLOSURE

In a first embodiment, the present disclosure provides a method of shape sorting abrasive particles, the method comprising:

providing a tool having a surface defining a plurality of shaped cavities having an average aspect ratio of at least 1.2;

providing initial crushed abrasive particles having a first average aspect ratio;

urging the initial crushed abrasive particles with agitation against the surface of the tool, thereby causing a first portion of the initial crushed abrasive particles to become retained within at least some of the shaped cavities and causing a second portion of the initial crushed abrasive particles to remain as loose particles on the surface of the tool, wherein substantially all of the shaped cavities contain at most one crushed abrasive particle;

separating the second portion of the initial crushed abrasive particles from the tool; and separating substantially all of the first portion of the initial crushed abrasive particles from the tool and isolating them as loose sorted crushed abrasive particles having a second average aspect ratio that is greater than the first average aspect ratio.

In a second embodiment, the present disclosure provides a method according to the first embodiment, wherein the shaped cavities are precisely-shaped.

In a third embodiment, the present disclosure provides a method according to the first or second embodiment, wherein said separating the loose particles from the tool comprises vibrating the loose particles off the tool.

In a fourth embodiment, the present disclosure provides a method according to the first or second embodiment, wherein said separating the loose particles from the tool comprises blowing the loose particles off the tool.

In a fifth embodiment, the present disclosure provides a method according to any one of the first to fourth embodiments, wherein the initial crushed abrasive particles conform to an abrasives industry specified nominal grade prior to disposing them on the surface of the tool.

In a sixth embodiment, the present disclosure provides a method according to the fifth embodiment, wherein the abrasives industry specified nominal grade is selected from the group consisting of ANSI grade designations ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600; FEPA grade designations P8, P12, P16, P24, P36, P40, P50, P60, P80, P100, P120, P150, P180, P220, P320, P400, P500, P600, P800, P1000, and P1200; and JIS grade designations JIS8, JIS12, JIS16, JIS24, JIS36, JIS 46, JIS 54, JIS 60, JIS 80, JIS 100, JIS 150, JIS 180, JIS 220, JIS 240, JIS 280, JIS 320, JIS 360, JIS 400, JIS 600, JIS 800, JIS 1000, JIS 1500, JIS 2500, JIS 4000, JIS 6000, JIS8000, and JIS 10000.

In a seventh embodiment, the present disclosure provides a method according to any one of the first to sixth embodiments, wherein the crushed abrasive particles comprise at least one of fused aluminum oxide, co-fused alumina-zirconia, ceramic aluminum oxide, green silicon carbide, black silicon carbide, chromia, zirconia, flint, cubic boron nitride, boron carbide, garnet, sintered alpha-alumina-based ceramic, and combinations thereof.

In an eighth embodiment, the present disclosure provides a method according to any one of the first to seventh embodiments, wherein the method is continuous.

In a ninth embodiment, the present disclosure provides a method according to the eighth embodiment, wherein the tool comprises an endless belt.

In a tenth embodiment, the present disclosure provides a method according to any one of the first to ninth embodiments, wherein the agitation is provided by vibrating the tool.

In an eleventh embodiment, the present disclosure provides a method according to any one of the first to tenth embodiments, wherein the second average aspect ratio is at least 20 percent greater than the first average aspect ratio.

In a twelfth embodiment, the present disclosure provides a method according to any one of the first to eleventh embodiments, wherein the initial crushed abrasive particles have an average particle diameter $D_{50}$ of at least 0.1 millimeter.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Table 1, below, lists various materials used in the examples.

TABLE 1

| ABBREVIATION | DESCRIPTION |
|---|---|
| AP1 | fused alumina-zirconia eutectic crushed abrasive particles, ANSI grade 24, obtained from Imerys Fused Minerals Villach GmbH, Villach, Austria |
| AP2 | BRFPL heat-treated semi-friable fused aluminum oxide particles, ANSI 36, obtained from Imerys Fused Minerals Villach GmbH, Villach, Austria |
| AP3 | SCTSK, pink cubic monocrystalline alumina particles, ANSI 24, obtained from Imerys Fused Minerals Villach GmbH, Villach, Austria |

TABLE 1-continued

| ABBREVIATION | DESCRIPTION |
|---|---|
| AP4 | crushed abrasive grain, obtained as 3M CERAMIC ABRASIVE GRAIN 321, GRADE 36 from 3M, Saint Paul, Minnesota |
| AP5 | FRSK, semi-friable brown fused alumina particles, ANSI 24, obtained from Imerys Fused Minerals Villach GmbH, Villach, Austria |
| AP6 | crushed abrasive grain, obtained as 3M CERAMIC ABRASIVE GRAIN 351, GRADE 24 from 3M, Saint Paul, Minnesota |

Example 1

A Camsizer XT by Retsch Technology GmbH was used to determine the aspect ratio, b/l (breadth divided by length) of the an initial AP1 sample. The aspect ratio was calculated as $$b/l = \frac{x_{c,min}}{x_{Fe,max}}$$

where $x_{c,min}$ is the shortest chord of the measured set of maximum chords of a particle projection and $x_{Fe,max}$ is the longest Feret diameter out of the measured set of Feret diameters $x_{Fe}$.

An acrylic tool 410, as shown in FIG. 4A, having precisely spaced and oriented equilateral triangular pockets with length of 1.73 mm/side with sidewall angles of 98 degrees relative to the bottom of each cavity, and a mold cavity depth of 0.0138 inch (0.35 mm) arranged in a radial array (all apexes pointing toward the perimeter) was then filled with AP1 particles (AP1) assisted by tapping. Crushed abrasive particles in excess of those accommodated into the tool's cavities were removed by shaking and tapping.

The Camsizer XT was used to determine the aspect ratio, b/l ratio of the AP1 sample that was selected by positioning tool 100. This sample was called AP1-Sorted.

The average aspect ratio for the initial AP1 particles as obtained from the manufacturer particles was 1.50, and after sorting the AP1-Sorted crushed abrasive particles had an average aspect ratio of 1.93.

The results showed that the mineral that had been collected in the pockets had a 29 percent higher length vs. breadth (l/b, recriprocal of b/l determined as above) aspect ratio than the bulk sample. The higher the l/b value, the sharper the particles are considered to be.

Example 2

Example 1 was repeated except that the abrasive grit sorted and analyzed was AP2. The sorted sample was called AP2-Sorted-A.

Example 3

Example 1 was repeated except that the abrasive grit sorted and analyzed was AP2. The tooling used for sorting is similar to acrylic tool 410, as shown in FIG. 4A and used in Example 1, except that the precisely spaced and oriented equilateral triangular pockets have length of 1.14 mm/side with sidewall angles of 94 degrees relative to the bottom of each cavity, and a mold cavity depth of 0.0159 inch (0.404 mm) arranged in a radial array (all apexes pointing toward the perimeter). The sample was called AP2-Sorted-B.

Example 4

Example 1 was repeated except that the abrasive grit sorted and analyzed was AP3. The sorted sample was called AP3-Sorted.

Example 5

Example 1 was repeated except that the abrasive grit sorted and analyzed was AP4. The sorted sample was called AP4-Sorted-A.

Example 6

Example 3 was repeated except that the abrasive grit sorted and analyzed was AP4. The sorted sample was called AP4-Sorted-B.

Example 7

Example 1 was repeated except that the abrasive grit sorted and analyzed was AP5. The sorted sample was called AP5-Sorted.

Example 8

Example 1 was repeated except that the abrasive grit sorted and analyzed was AP6. The sorted sample was called AP6-Sorted.

Table 2, below, reports aspect ratio (l/b, length/breadth) for Examples 1-8.

TABLE 2

| Example | Bulk | Sorted Sample | $(l/b)_{AP\text{-}Bulk}$ | $(l/b)_{AP\text{-}Sorted}$ | $\frac{(l/b)_{AP-Bulk}}{(l/b)_{AP-Sorted}} - 1$ |
|---|---|---|---|---|---|
| 1 | AP1 | AP1-Sorted | 1.5018 | 1.9345 | 0.29 |
| 2 | AP2 | AP2-Sorted-A | 1.5244 | 1.6849 | 0.11 |
| 3 | AP2 | AP2-Sorted-B | 1.5244 | 1.5720 | 0.03 |
| 4 | AP3 | AP3-Sorted | 1.4074 | 1.5831 | 0.12 |
| 5 | AP4 | AP4-Sorted-A | 1.8129 | 1.8042 | 0.00 |
| 6 | AP4 | AP4-Sorted-B | 1.8129 | 1.9345 | 0.07 |
| 7 | AP5 | AP5-Sorted | 1.6339 | 1.8713 | 0.15 |
| 8 | AP6 | AP6-Sorted | 1.763 | 1.8934 | 0.07 |

The results show that most minerals that had been collected in the pockets (AP-Sorted) had a higher length vs. breadth (l/b) aspect ratio than the bulk sample. The higher the l/b value, the sharper the particles are considered to be. The one exception to this was AP4-Sorted-A. However, AP4-Sorted-B did have a higher length vs. breadth (l/b) aspect ratio than the bulk sample which indicates that the pocket dimensions with respect to the particle size is important. For example, AP4 was sorted better with a larger pocket size. In contrast, AP2 was sorted better using a tool with a smaller pocket size.

All cited references, patents, and patent applications in the Detailed Description and Examples sections of the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of shape sorting abrasive particles, the method comprising:

providing a tool having a surface defining a plurality of shaped cavities having an average aspect ratio of at least 1.2, wherein the tool comprises an endless belt, a drum, a web, or a sleeve;

providing initial crushed abrasive particles having a first average aspect ratio;

urging the initial crushed abrasive particles with agitation against the surface of the tool, thereby causing a first portion of the initial crushed abrasive particles to become retained within at least some of the shaped cavities and causing a second portion of the initial crushed abrasive particles to remain as loose particles on the surface of the tool, wherein substantially all of the shaped cavities contain at most one crushed abrasive particle;

separating the second portion of the initial crushed abrasive particles from the tool; and separating substantially all of the first portion of the initial crushed abrasive particles from the tool and isolating them as loose sorted crushed abrasive particles having a second average aspect ratio that is greater than the first average aspect ratio.

2. The method of claim 1, wherein the shaped cavities are precisely-shaped.

3. The method of claim 1, wherein said separating the loose particles from the tool comprises vibrating the loose particles off the tool.

4. The method of claim 1, wherein said separating the loose particles from the tool comprises blowing the loose particles off the tool.

5. The method of claim 1, wherein the initial crushed abrasive particles conform to an abrasives industry specified nominal grade prior to disposing them on the surface of the tool.

6. The method of claim 5, wherein the abrasives industry specified nominal grade is selected from the group consisting of ANSI grade designations ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600; FEPA grade designations P8, P12, P16, P24, P36, P40, P50, P60, P80, P100, P120, P150, P180, P220, P320, P400, P500, P600, P800, P1000, and P1200; and JIS grade designations JIS8, JIS12, JIS16, JIS24, JIS36, JIS 46, JIS 54, JIS 60, JIS 80, JIS 100, JIS 150, JIS 180, JIS 220, JIS 240, JIS 280, JIS 320, JIS 360, JIS 400, JIS 600, JIS 800, JIS 1000, JIS 1500, JIS 2500, JIS 4000, JIS 6000, JIS8000, and JIS 10000.

7. The method of claim 1, wherein the crushed abrasive particles comprise at least one of fused aluminum oxide, co-fused alumina-zirconia, ceramic aluminum oxide, green silicon carbide, black silicon carbide, chromia, zirconia, flint, cubic boron nitride, boron carbide, garnet, sintered alpha-alumina-based ceramic, and combinations thereof.

8. The method of claim 1, wherein the method is continuous.

9. The method of claim 8, wherein the tool comprises an endless belt.

10. The method of claim 1, wherein the agitation is provided by vibrating the tool.

11. The method of claim 1, wherein the second average aspect ratio is at least 20 percent greater than the first average aspect ratio.

12. The method of claim 1, wherein the initial crushed abrasive particles have an average particle diameter $D_{50}$ of at least 0.1 millimeter.

* * * * *